US009905938B2

(12) United States Patent
So et al.

(10) Patent No.: US 9,905,938 B2
(45) **Date of Patent: *Feb. 27, 2018**

(54) DUAL POLARIZED HIGH GAIN AND WIDEBAND COMPLEMENTARY ANTENNA

(71) Applicant: City University of Hong Kong, Kowloon (HK)

(72) Inventors: Kwok Kan So, Kowloon (HK); Hau Wah Lai, Kowloon (HK); Hang Wong, Kowloon (HK); Chi Hou Chan, Kowloon Tong (HK); Kwai Man Luk, Kowloon (HK)

(73) Assignee: CITY UNIVERSITY OF HONG KONG, Kowloon (HK)

( * ) Notice: Subject to any disclaimer, the term of this patent is extended or adjusted under 35 U.S.C. 154(b) by 388 days.

This patent is subject to a terminal disclaimer.

(21) Appl. No.: 14/608,711

(22) Filed: Jan. 29, 2015

(65) Prior Publication Data

US 2016/0226156 A1 Aug. 4, 2016

(51) Int. Cl.
*H01Q 21/24* (2006.01)
*H01Q 9/04* (2006.01)
*H01Q 9/26* (2006.01)

(52) U.S. Cl.
CPC ..... *H01Q 21/24* (2013.01); *H01Q 9/0421* (2013.01); *H01Q 9/26* (2013.01)

(58) Field of Classification Search
CPC ..... H01Q 9/16; H01Q 9/0407; H01Q 21/26; H01Q 21/28

(Continued)

(56) References Cited

U.S. PATENT DOCUMENTS 3,594,806 A 7/1971 Black et al.
4,724,443 A * 2/1988 Nysen ..... H01Q 9/045 343/700 MS (Continued)

FOREIGN PATENT DOCUMENTS

CN 100428564 C 10/2008
CN 103682588 A 3/2014

OTHER PUBLICATIONS

Mak, et al., "A Shorted Bowtie Patch Antenna With a Cross Dipole for Dual Polarization," Antennas and Wireless Propagation Letters, 2007, pp. 126-129, vol. 6, IEEE.

*Primary Examiner* — Dameon E Levi
*Assistant Examiner* — Ab Salam Alkassim, Jr.
(74) *Attorney, Agent, or Firm* — Amin, Turocy & Watson, LLP

(57) ABSTRACT

A dual polarized high gain and wideband complementary antenna is presented herein. A dual polarized antenna can include a ground plane, a folded dipole portion electrically coupled to the ground plane, a shorted patch antenna portion including an open end that is electrically coupled to the folded dipole portion, and a metal plate located at a bottom portion of the dual polarized antenna. In one example, the folded dipole portion can include four folded dipoles. Further, the open end of the shorted patch antenna portion can be electrically coupled to the folded dipole portion using the metal plate. Further, the dual polarized antenna can include two ports—each port including a pair of feeding sources, and each feeding source configured to generate an electric dipole and a magnetic dipole. In another example, magnitudes of the electric dipoles can be equivalent, and magnitudes of the magnetic dipoles can be equivalent.

20 Claims, 26 Drawing Sheets

(58) Field of Classification Search
USPC ..... 343/730
See application file for complete search history.

(56) References Cited

U.S. PATENT DOCUMENTS

| | | | | |
|---|---|---|---|---|
| 4,903,033 | A | 2/1990 | Tsao et al. | |
| 6,034,649 | A | 3/2000 | Wilson et al. | |
| 6,072,439 | A | 6/2000 | Ippolito et al. | |
| 6,317,084 | B1 | 11/2001 | Chen et al. | |
| 6,437,750 | B1 * | 8/2002 | Grimes | H01Q 7/00 343/726 |
| 6,593,887 | B2 * | 7/2003 | Luk | H01Q 1/40 343/700 MS |
| 7,119,746 | B2 | 10/2006 | Luk et al. | |
| 7,310,066 | B1 | 12/2007 | Li | |
| 7,579,999 | B2 | 8/2009 | Bo.beta et al. | |
| 7,629,939 | B2 | 12/2009 | Deng et al. | |
| 7,843,389 | B2 | 11/2010 | Luk et al. | |
| 7,999,744 | B2 | 8/2011 | Chin et al. | |
| 8,138,986 | B2 * | 3/2012 | McMahon | H01Q 1/246 343/817 |
| 8,325,093 | B2 * | 12/2012 | Holland | H01P 5/10 343/700 MS |
| 8,803,748 | B2 * | 8/2014 | Lim | H01Q 1/3275 343/711 |
| 8,907,857 | B2 * | 12/2014 | Nysen | H01Q 21/28 343/729 |
| 9,083,086 | B2 * | 7/2015 | Chan | H01Q 9/0407 |
| 9,287,617 | B2 * | 3/2016 | Kokkinos | H01Q 1/523 |
| 2001/0054983 | A1 * | 12/2001 | Judd | H01Q 1/246 343/810 |
| 2005/0110683 | A1 * | 5/2005 | Song | H01Q 1/246 343/700 MS |
| 2007/0080878 | A1 * | 4/2007 | McLean | H01Q 1/38 343/725 |
| 2007/0210976 | A1 * | 9/2007 | Luk | H01Q 9/0421 343/793 |
| 2009/0295667 | A1 * | 12/2009 | Ma | H01Q 1/2225 343/795 |
| 2011/0109524 | A1 * | 5/2011 | Saily | H01Q 21/08 343/893 |
| 2013/0088402 | A1 * | 4/2013 | Lindmark | H01Q 1/246 343/848 |
| 2013/0214982 | A1 * | 8/2013 | Dean | H01Q 9/285 343/795 |
| 2016/0190869 | A1 * | 6/2016 | Shao | H02J 17/00 307/149 |

* cited by examiner

500

800

1200

1300

1400

1500

1600

$f = 2.6$ GHz at port 102

1700

$f = 2.9$ GHz at port 102

1800

$f = 3.2$ GHz at port 102

1900

$f$ = 3.5 GHz at port 102

2000

$f = 3.8$ GHz at port 102

2100

$f$ = 2.6 GHz at port 104

2200

$f = 2.9$ GHz at port 104

2300

$f$ = 3.2 GHz at port 104

2400

$f$ = 3.5 GHz at port 104

2500

$f = 3.8$ GHz at port 104

2600

DUAL POLARIZED HIGH GAIN AND WIDEBAND COMPLEMENTARY ANTENNA

TECHNICAL FIELD

The subject disclosure generally relates to embodiments for a dual polarized high gain and wideband complementary antenna.

BACKGROUND

Conventional antenna technologies including magneto-electric dipole and linearly-polarized antennas are associated with high gain and wideband characteristics. However, such technologies have had some drawbacks, some of which may be noted with reference to the various embodiments described herein below.

BRIEF DESCRIPTION OF THE DRAWINGS

Non-limiting embodiments of the subject disclosure are described with reference to the following figures, wherein like reference numerals refer to like parts throughout the various views unless otherwise specified.

DETAILED DESCRIPTION

Figure 1:
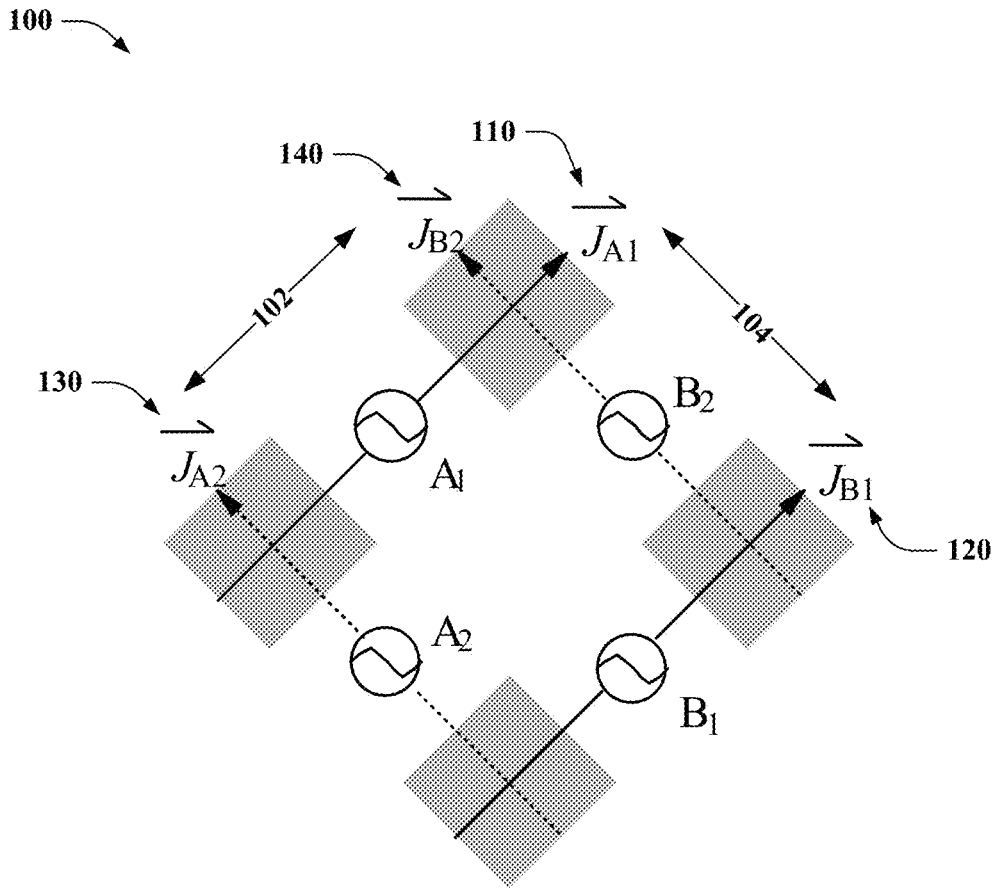
FIG. 1 illustrates a block diagram of electric dipoles of a dual-polarized antenna, in accordance with various embodiments.

Aspects of the subject disclosure will now be described more fully hereinafter with reference to the accompanying drawings in which example embodiments are shown. In the following description, for purposes of explanation, numerous specific details are set forth in order to provide a thorough understanding of the various embodiments. However, the subject disclosure may be embodied in many different forms and should not be construed as limited to the example embodiments set forth herein.

Conventional antenna technologies have had some drawbacks with respect to effectively coupling bandwidth and gain enhancements for dual-polarized antennas. Various embodiments disclosed herein provide for a dual-polarized high gain and wideband antenna associated with a low profile and efficient design utilizing a folded dipole and shorted patch antenna.

For example, an antenna, e.g., dual-polarized antenna, can comprise a ground plane, e.g., an electrically conductive surface, a folded dipole, e.g., half-wave dipole, portion electrically coupled to the ground plane, a shorted patch antenna portion comprising an open end that is electrically coupled to the folded dipole portion, and a metal plate located at a bottom portion, e.g., bottom, of the dual-polarized antenna.

In an embodiment, the ground plane can comprise two H-shaped ground planes, and the folded dipole portion can be electrically connected to the two H-shaped ground planes. In another embodiment, the folded dipole portion can comprise four folded dipoles. In yet another embodiment, the shorted patch antenna portion can comprise four open ends (e.g., comprising the open end) that are electrically coupled to the four folded dipoles.

In an embodiment, the dual-polarized antenna can further comprise two ports—each port comprising a pair of feeding sources. In this regard, each feeding source of the pair of feeding sources of each port can be configured to generate an electric dipole and a magnetic dipole. In one embodiment, the magnitudes of the electric dipoles can be equivalent. Further, the magnitudes of the magnetic dipoles can be equivalent.

In another embodiment, the metal plate can be configured to reduce back radiation. In yet another embodiment, the metal plate can comprise a reflector or another ground plane. In an embodiment, each feeding source of the pair of feeding sources can comprise a pair of microstrip lines, a stub with a shorting pin, and a pair of L-shaped strips, e.g., electrically connected to the pair of microstrip lines and the stub.

In an embodiment, the ground plane can comprise an H-shaped ground plane. Further, the pair of micro strip lines, the stub, and the pair of L-shaped strips of each feeding source of the pair of feeding sources can be printed, formed, etc. on a top layer of a substrate. Furthermore, the H-shaped ground plane can be printed, formed, etc. on a bottom layer of the substrate.

In one embodiment, the antenna can comprise a balun source, e.g., corresponding to open portions of the ground plane. In an example, each feeding source of the pair of feeding sources can form a Marchand balun source, e.g., which can provide 180° phase difference across a respective open slot of the ground plane.

In another embodiment, an array of antennas can comprise a ground plane, a set of dual-polarized antennas, and a metal plate located at a bottom portion, e.g., bottom, of the array of antennas. Further, a dual-polarized antenna of the set of dual-polarized antennas can comprise a folded dipole antenna portion electrically coupled to the ground plane and a shorted patch antenna portion comprising an open end that is electrically coupled, e.g., using the metal plate, to the folded dipole portion.

In yet another embodiment, adjacent dual-polarized antennas of the set of dual-polarized antennas can be separated by a defined spacing. In an embodiment, the metal plate can be located below the set of dual-polarized antennas.

In one embodiment, a dual-polarized antenna can comprise a ground plane, a folded dipole antenna electrically coupled to the ground plane, a shorted patch antenna comprising an open portion that is electrically coupled to the folded dipole antenna, and a metal plate located below the folded dipole antenna. In an embodiment, the ground plane can comprise H-shaped ground planes, e.g., electrically connected to the folded dipole antenna. In another embodiment, the folded dipole antenna can comprise four folded dipoles.

Reference throughout this specification to "one embodiment," or "an embodiment," means that a particular feature, structure, or characteristic described in connection with the embodiment is included in at least one embodiment. Thus, the appearances of the phrase "in one embodiment," or "in an embodiment," in various places throughout this specification are not necessarily all referring to the same embodiment. Furthermore, the particular features, structures, or characteristics may be combined in any suitable manner in one or more embodiments.

To the extent that the terms "includes," "has," "contains," and other similar words are used in either the detailed description or the appended claims, such terms are intended to be inclusive—in a manner similar to the term "comprising" as an open transition word—without precluding any additional or other elements. Moreover, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Further, the word "exemplary" and/or "demonstrative" is used herein to mean serving as an example, instance, or illustration. For the avoidance of doubt, the subject matter disclosed herein is not limited by such examples. In addition, any aspect or design described herein as "exemplary" and/or "demonstrative" is not necessarily to be construed as preferred or advantageous over other aspects or designs, nor is it meant to preclude equivalent exemplary structures and techniques known to those of ordinary skill in the art having the benefit of the instant disclosure.

Figure 2:
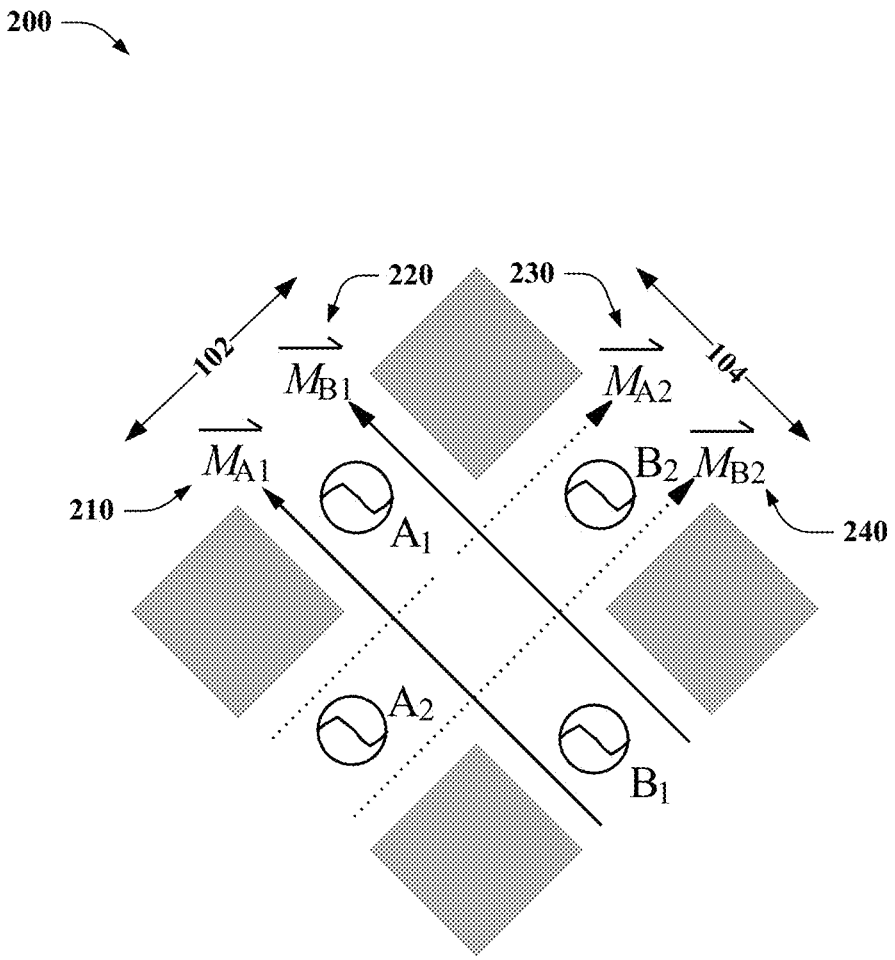
FIG. 2 illustrates a block diagram of magnetic dipoles of a dual-polarized antenna, in accordance with various embodiments.

Conventional antenna technologies have had some drawbacks with respect to effectively combining bandwidth and gain enhancements for dual-polarized antennas. On the other hand, various embodiments disclosed herein provide for an effective, low profile dual-polarized high gain and wideband complementary antenna utilizing a folded dipole and shorted patch antenna. In this regard, and now referring to FIGS. 1 and 2, block diagrams (100 and 200) of electric dipoles (110, 120, 130, 140) and magnetic dipoles (210, 220, 230, and 240) of a dual-polarized antenna are illustrated, in accordance with various embodiments. As illustrated by FIGS. 1 and 2, ports 102 and 104 comprise two feeding sources—$A_1$ and $B_1$ for port 102, and $A_2$ and $B_2$ for port 104. Each feeding source is configured to generate one electric dipole—$A_1$ generating electric dipole 110 for port 102, $B_1$ generating electric dipole 120 for port 102, $A_2$ generating electric dipole 130 for port 104, and $B_2$ generating electric dipole 140 for port 104. Further, each feeding source is configured to generate one magnetic dipole—$A_1$ generating magnetic dipole 210 for port 102, $B_1$ generating magnetic dipole 220 for port 102, $A_2$ generating magnetic dipole 230 for port 104, and $B_2$ generating magnetic dipole 240 for port 104.

In an embodiment, the magnitudes of the two feeding sources are the same at each port, e.g., electric dipole 110=electric dipole 120=$\vec{J}_1$, and magnetic dipole 210=magnetic dipole 220=$\vec{M}_1$ for port 102; electric dipole 130=electric dipole 140=$\vec{J}_2$, and magnetic dipole 230=magnetic dipole 240=$\vec{M}_2$ for port 104. In this regard, the dual-polarized antenna effectively generates two electric dipoles and two magnetic dipoles, with their electrical characteristic $(2\vec{J}_1+2\vec{M}_1)$ and $(2\vec{J}_2+2\vec{M}_2)$ being doubled—achieving around 3 dB gain higher than conventional magneto-electric dipole antennas.

Figure 3:
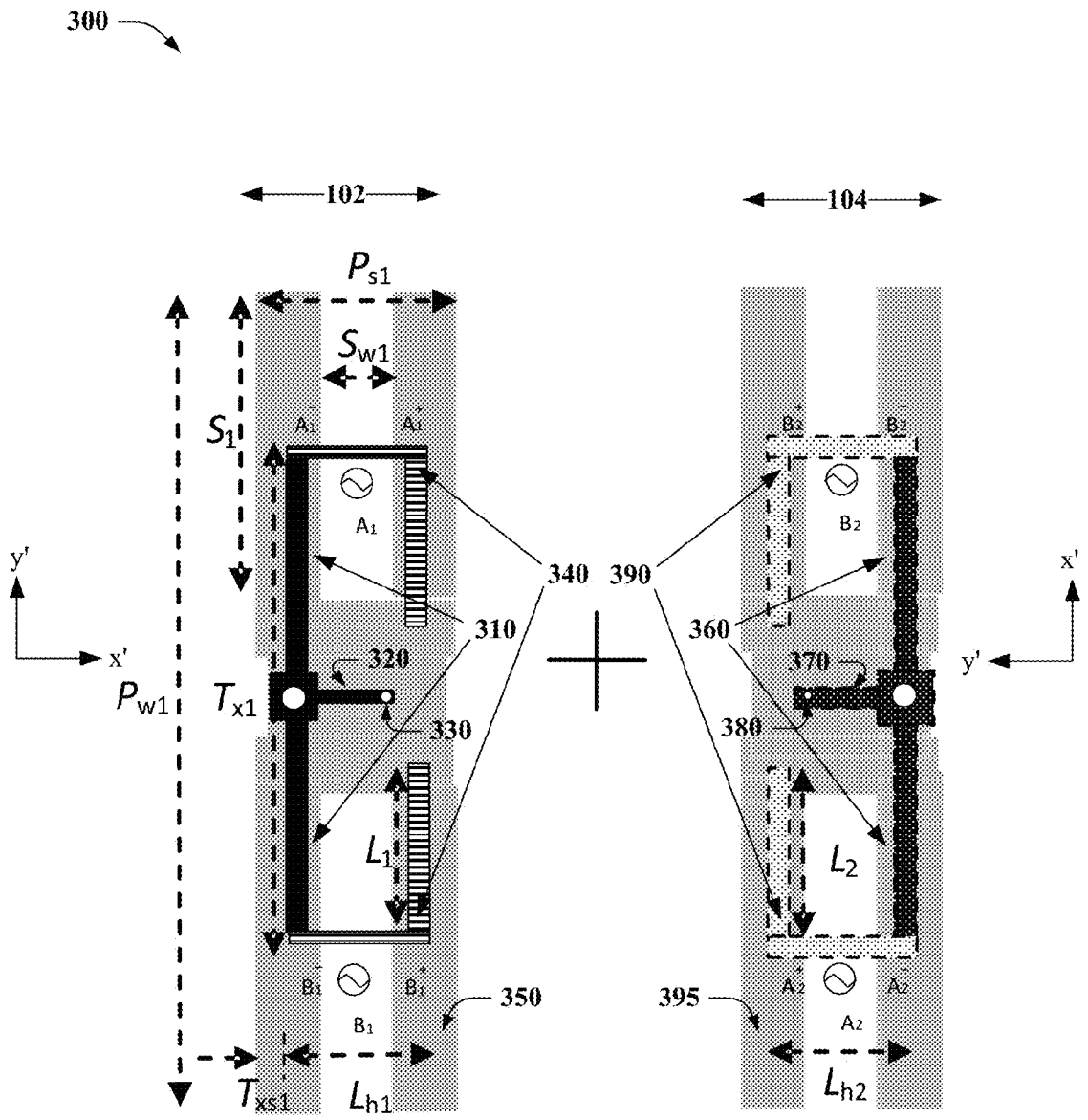
FIG. 3 illustrates a block diagram of top views of feeding mechanisms for a first port of a dual-polarized antenna and a second port of the dual-polarized antenna, in accordance with various embodiments.
Figure 4:
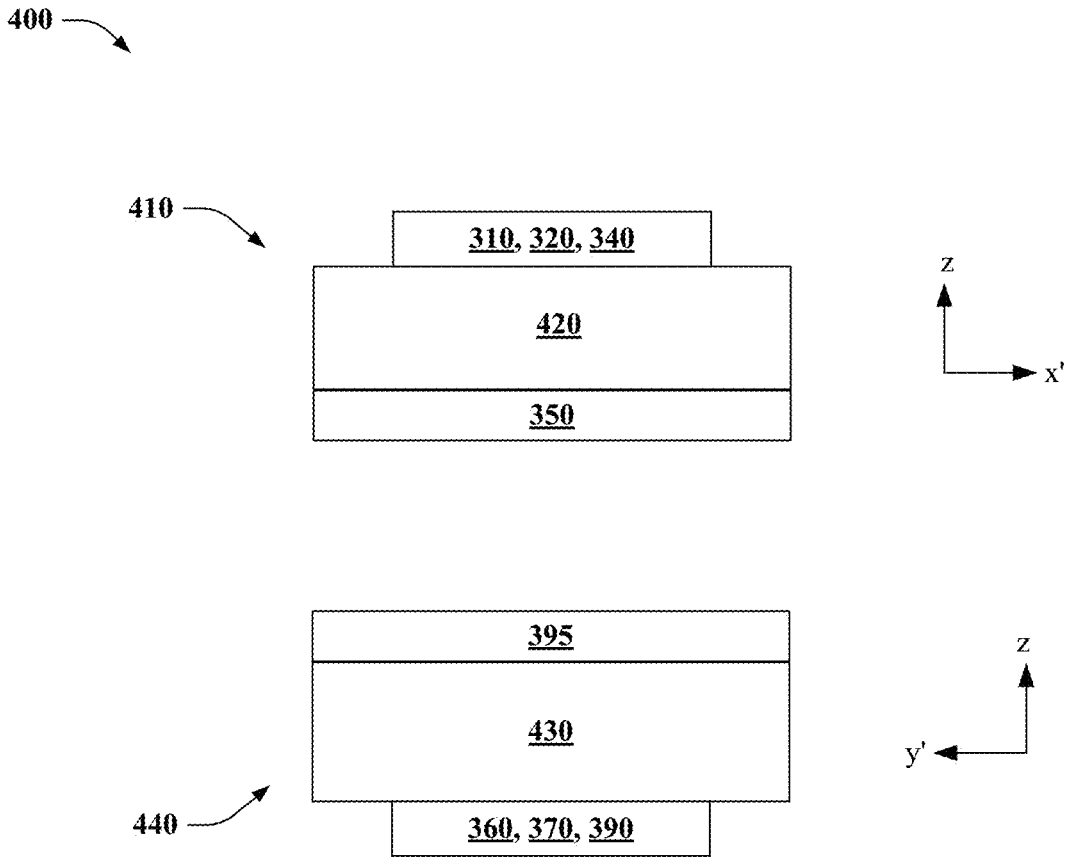
FIG. 4 illustrates a block diagram of a side view of feeding mechanisms for a first port of a dual-polarized antenna and a second port of the dual-polarized antenna, in accordance with various embodiments.

Referring now to FIG. 3, a block diagram (300) of top views of a feeding mechanism for a first port (102) of a dual-polarized antenna and a second port (104) of the dual-polarized antenna are illustrated, in accordance with various embodiments. In this regard, the feeding mechanism, network, etc. (e.g., see 410 below) of port 102 comprises H-shaped ground plane 350 and pair of microstrip lines 310 and stub 320 with shorting pin 330 electrically connected to pair of L-shaped strips 340. In an embodiment illustrated by FIG. 4, pair of microstrip lines 310, stub 320, and pair of L-shaped strips 340 can be printed, formed, etc. on a top layer of substrate 420, and H-shaped ground plane 350 can be printed, formed, etc. on a bottom layer of substrate 420 to form feeding mechanism 410.

The feeding mechanism, network, etc. (e.g., see 440 below) of port 104 comprises H-shaped ground plane 395 and pair of microstrip lines 360 and stub 370 with shorting pin 380 electrically connected to pair of L-shaped strips 390. In an embodiment illustrated by FIG. 4, pair of microstrip lines 360, stub 370, and pair of L-shaped strips 390 can be printed, formed, etc. on a bottom layer of substrate 430, and H-shaped ground plane 395 can be printed, formed, etc. on a top layer of substrate 430 to form feeding mechanism 440.

Table I below defines geometrical parameters corresponding to the feeding mechanisms for the first and second ports (102 and 104) of the dual-polarized antenna, in which $\lambda_o$ is the free-space wavelength of the center frequency of the antenna:

TABLE I

| Parameters | $P_{w1}$ | $P_{s1}$ | $S_{w1}$ | $S_1$ | $T_{x1}$ | $T_{xs1}$ | $L_{h1}$ | $L_1$ | $L_{h2}$ | $L_2$ |
|---|---|---|---|---|---|---|---|---|---|---|
| Values (mm) | 62 $0.661\lambda_0$ | 16 $0.171\lambda_0$ | 5 $0.053\lambda_0$ | 24.5 $0.261\lambda_0$ | 37.5 $0.4\lambda_0$ | 2.75 $0.029\lambda_0$ | 10 $0.107\lambda_0$ | 13.5 $0.144\lambda_0$ | 10.4 $0.111\lambda_0$ | 12.5 $0.133\lambda_0$ |

Figure 5:
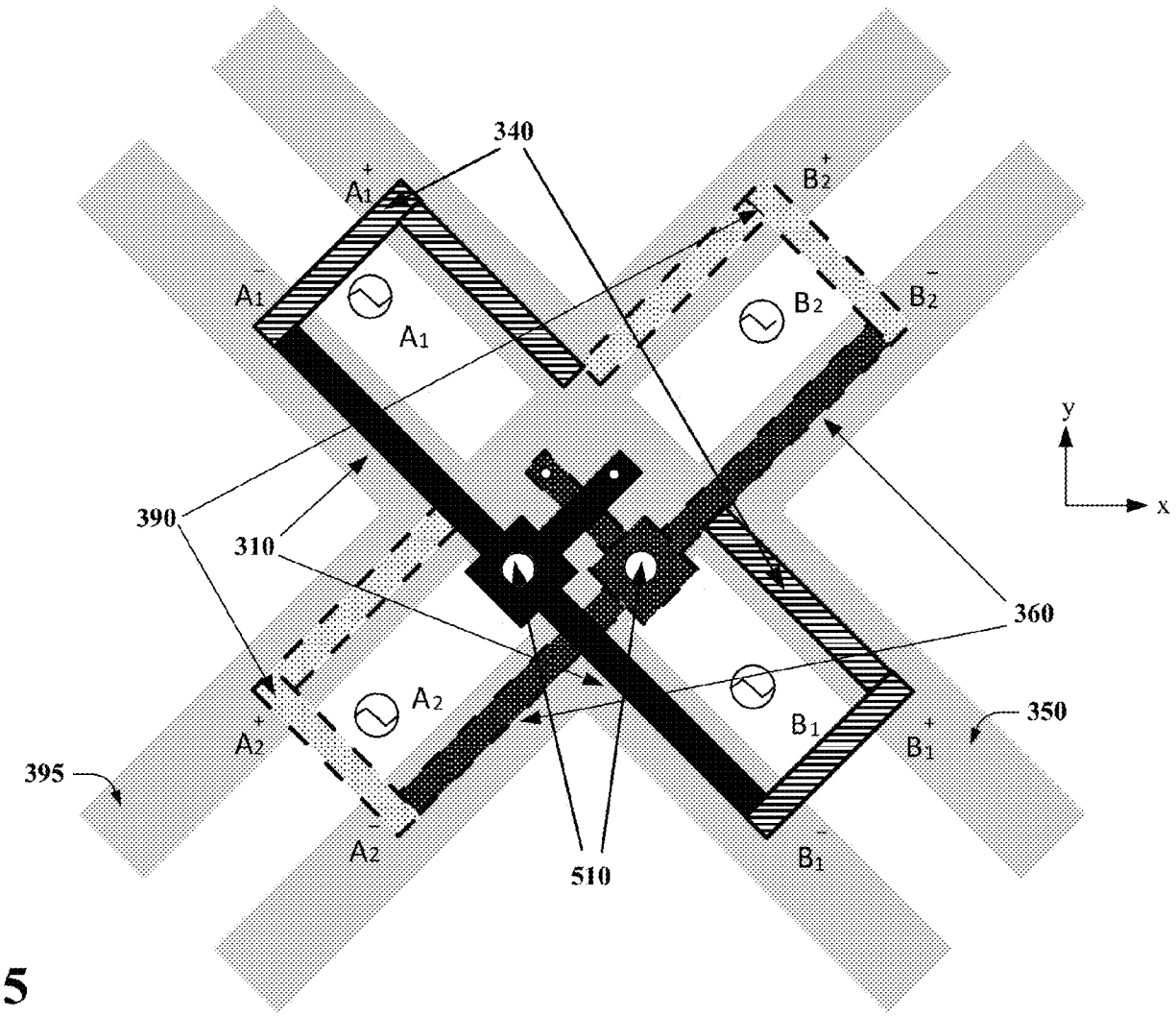
FIG. 5 illustrates a block diagram of a top view of combined feeding mechanisms for a dual polarized antenna, in accordance with various embodiments.
Figure 6:
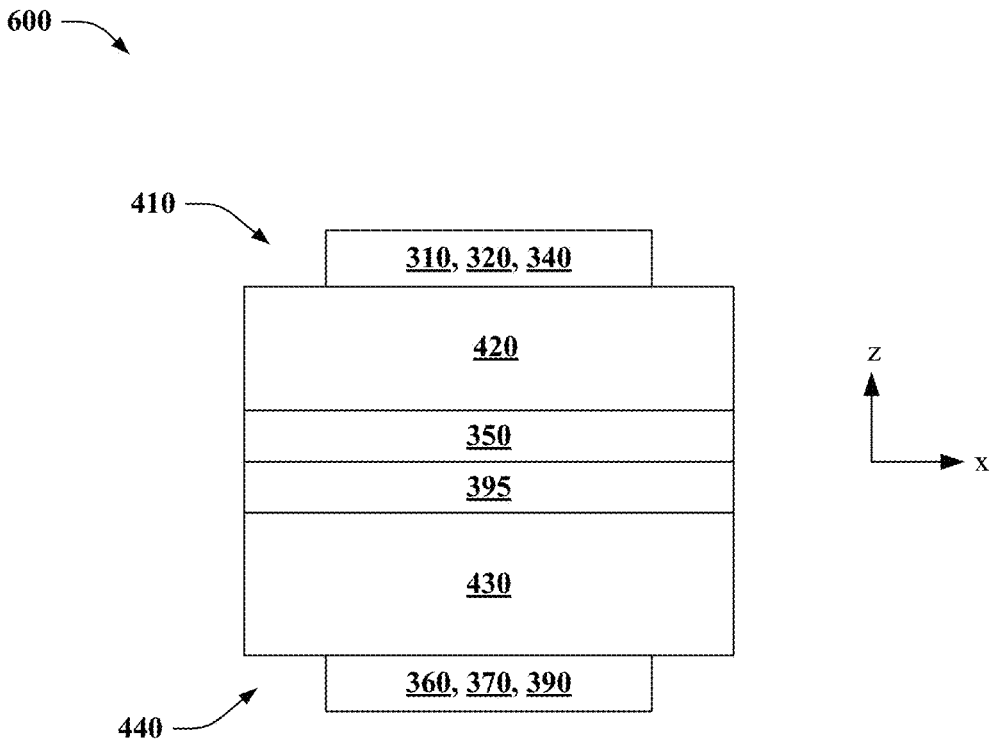
FIG. 6 illustrates a block diagram of a side view of combined feeding mechanisms for a dual polarized antenna, in accordance with various embodiments.

FIG. 5 illustrates a block diagram (500) of a top view of combined feeding mechanisms for a dual-polarized antenna, in accordance with various embodiments. As illustrated by FIG. 5, a dual-polarized combined feeding mechanism can be formed by orthogonally crossing feeding mechanism 410 and feeding mechanism 440—securing, as illustrated by FIG. 6, H-shaped ground plane 350 to H-shaped ground plane 395. In this regard, the coordinates of feeding mechanism 410 and 440 have been rotated at $\phi=-45°$ and 45°, respectively, for viewing the dual polarized antenna structure more easily.

act as a reflector of electromagnetic waves for the dual-polarized antenna, e.g., when support pillars 1010 comprise an insulator. In another embodiment, when support pillars comprise a conductor, 350 and 395 can be electrically connected to metal plate 820, e.g., which becomes a ground plane. Connectors 1020 can be electronically coupled, connected, shorted, etc. to feeding points 510 (see above). Further, Table II below defines geometrical parameters corresponding to the dual-polarized antenna illustrated by FIGS. 8-10, in which $\lambda_o$ is the free-space wavelength of the center frequency of the dual-polarized antenna:

TABLE II

| Parameters | $L_R$ | $D_1$ | $h_t$ | $h_D$ | $h_{DF}$ | $h_{sub}$ | $h_{sp}$ |
|---|---|---|---|---|---|---|---|
| Values (mm) | 150 $1.6\lambda_0$ | 23 $0.245\lambda_0$ | 18 $0.192\lambda_0$ | 10.8 $0.115\lambda_0$ | 6 $0.064\lambda_0$ | 1 $0.011\lambda_0$ | 6.2 $0.066\lambda_0$ |

Feeding points 510 can be located at the middle of respective pairs of microstrip lines (e.g., 310, 360). In an embodiment, short-circuited stubs (e.g., 320, 370) can be used for performing fine tuning and/or impedance matching for the dual-polarized antenna. In another embodiment, each L-shaped strip (e.g., 340, 390) can have a portion overlapping with open slot(s) of the H-shaped ground planes (e.g., 350, 395). Further, each feeding mechanism (e.g., 410, 440) can form a Marchand balun source that can provide a precise 180° phase difference across an open slot on a ground plane at $A^-_1$ and $A^+_1$, $B^-_1$ and $B^+_1$, $A^-_2$ and $A^+_2$, or $B^-_2$ and $B^+_2$, with minimum transmission loss and equal balanced impedances.

Figure 7:
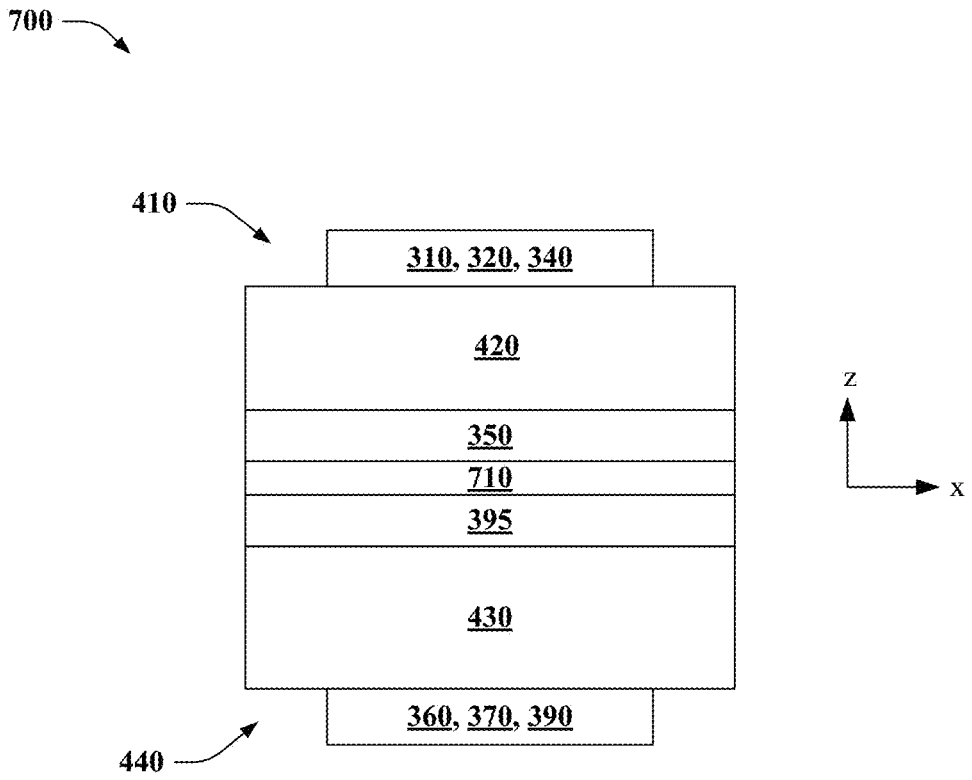
FIG. 7 illustrates a block diagram of another side view of combined feeding mechanisms for a dual polarized antenna, in accordance with various embodiments.

In embodiment(s) illustrated by FIG. 7, gap 710 can be included between the H-shaped ground planes (e.g., 350, 395). In other embodiment(s), (see e.g. FIG. 6), no gap exists between the H-shaped ground planes.

Figure 8:
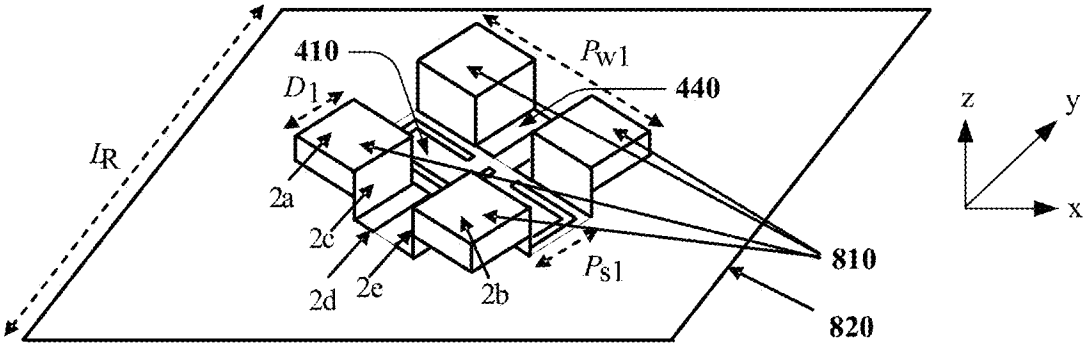
FIG. 8 illustrates a block diagram of a perspective of a dual-polarized antenna, in accordance with various embodiments.
Figure 9:
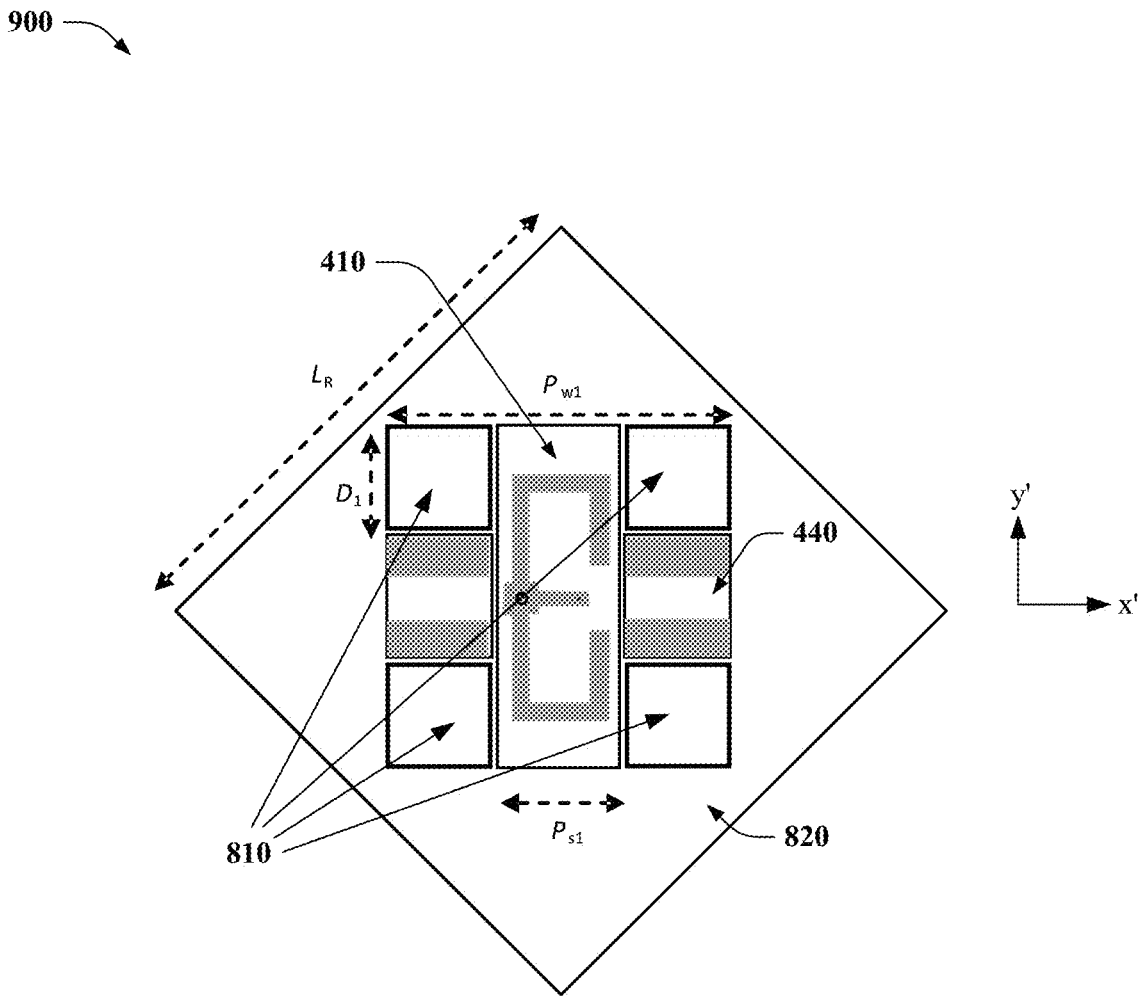
FIG. 9 illustrates a block diagram of a top view of a dual-polarized antenna, in accordance with various embodiments.
Figure 10:
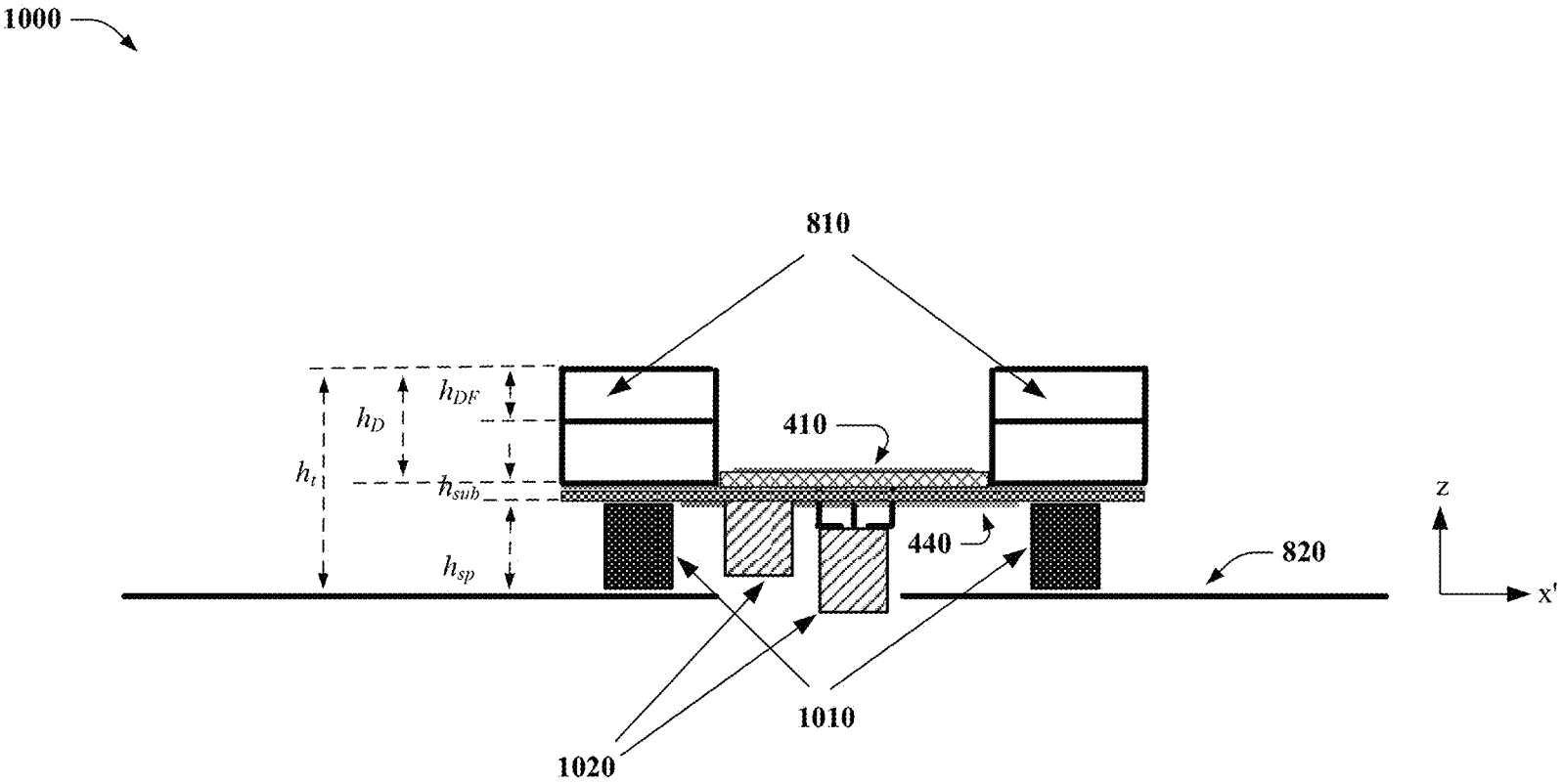
FIG. 10 illustrates a block diagram of a side view of a dual-polarized antenna, in accordance with various embodiments.

Now referring to FIGS. 8-10, a perspective of a dual-polarized antenna, a top view of the dual-polarized antenna, and a side view of the dual-polarized antenna are illustrated, in accordance with various embodiments. As illustrated by FIGS. 8 and 9, an H-shaped ground plane (e.g., 350, 395) of the dual-polarized combined feeding mechanism (see FIG. 5) can be connected to four folded dipoles (810). In this regard, folded dipoles (e.g., 2*a* and 2*b*) can be connected to an open end of a vertically-oriented shorted patch antenna (e.g., formed by 2*c*, 2*d* and 2*e*), with a metal plate 820 located below such feeding mechanism for back radiation reduction.

In one or more embodiments, the length of a folded dipole (810), $D_1$, and height of shorted patch antenna (see 2*c*, 2*d*, and 2*e*), $h_D$, are $0.245\lambda_o$ and $0.115\lambda_o$, respectively. In other embodiment(s), the separation of the two vertical metal plates (2*c* and 2*e*), $P_{s1}$, of the shorted patch antenna is $0.171\lambda$. In yet other embodiment(s), the size of the metal plate (820), $L_R$, can be optimized to obtain a back radiation of less than −20 dBi.

Figure 11:
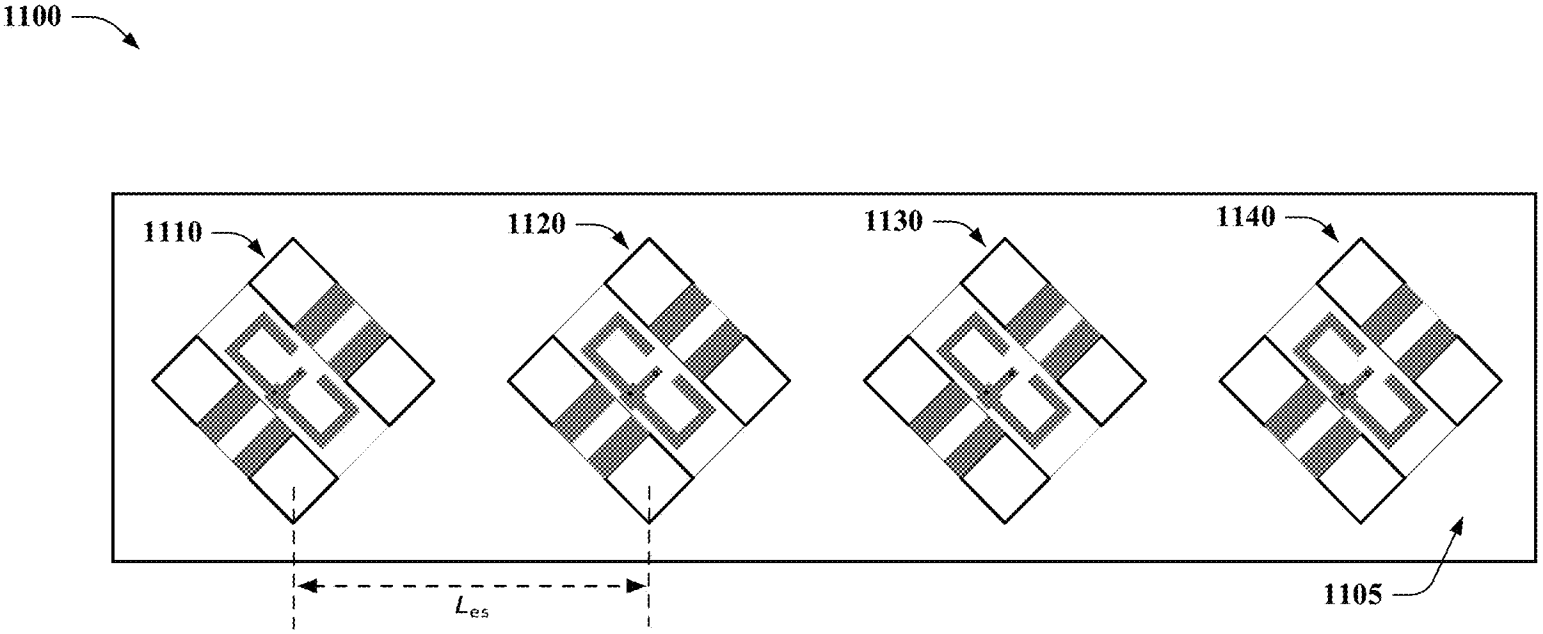
FIG. 11 illustrates a block diagram of a dual-polarized antenna array, in accordance with various embodiments.

As illustrated by FIG. 10, support pillars 1010 can comprise an insulator or a conductor and can separate feeding mechanisms (410 and 440) from metal plate 820, which can FIG. 11 illustrates a block diagram (1100) of a dual-polarized antenna array, in accordance with various embodiments. Dual-polarized antenna elements (1110, 1120, 1130, 1140) can include dual-polarized antennas described above (see also FIGS. 5-10). In this regard, as illustrated by FIG. 11, dual-polarized antenna array includes four dual-polarized antennas separated by element spacing, $L_{es}$, which have been placed over metal plate 1105. In order to obtain a specific gain or half power beamwidth for some wireless communication systems, an M×N antenna array can be constructed.

Figure 12:
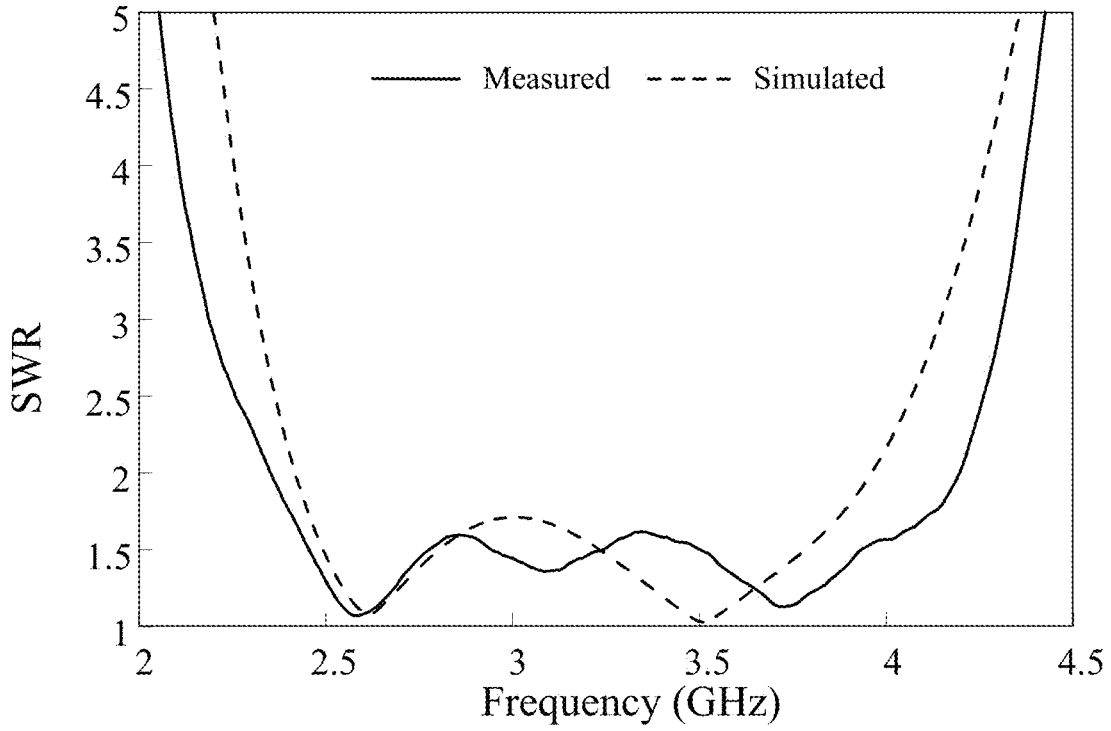
FIGS. 12-13 illustrate measured and simulated SWR against frequency for a first port and a second port, respectively, of a dual-polarized antenna, in accordance with various embodiments.
Figure 13:
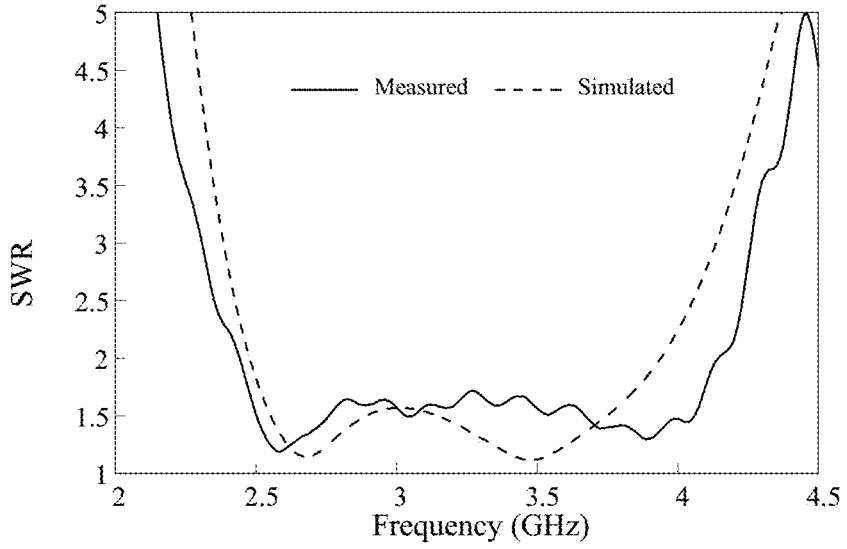

FIGS. 12-13 illustrate measured and simulated standing wave ratio (SWR) against frequency for a first port (102) and a second port (104), respectively, of a dual-polarized antenna, in accordance with various embodiments. In this regard, the dual-polarized antenna has wide measured impedance bandwidths of 55.9% (with SWR≤2 from 2.36 GHz to 4.19 GHz) at port 102 and 51.7% (with SWR≤2 from 2.44 GHz to 4.14 GHz) at port 104, respectively.

Figure 14:
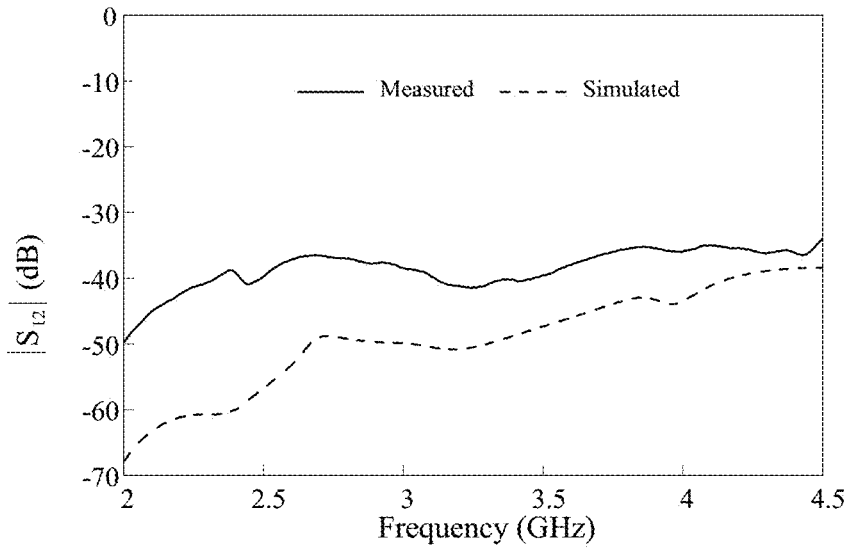
FIG. 14 illustrates measured and simulated isolation between two ports of a dual-polarized antenna, in accordance with various embodiments.

FIG. 14 illustrates measured and simulated isolation between two ports (e.g., 102 and 104) of a dual-polarized antenna, in accordance with various embodiments. In this regard, measured isolation is more than 35 dB across the entire operating bandwidth of the dual-polarized antenna.

Figure 15:
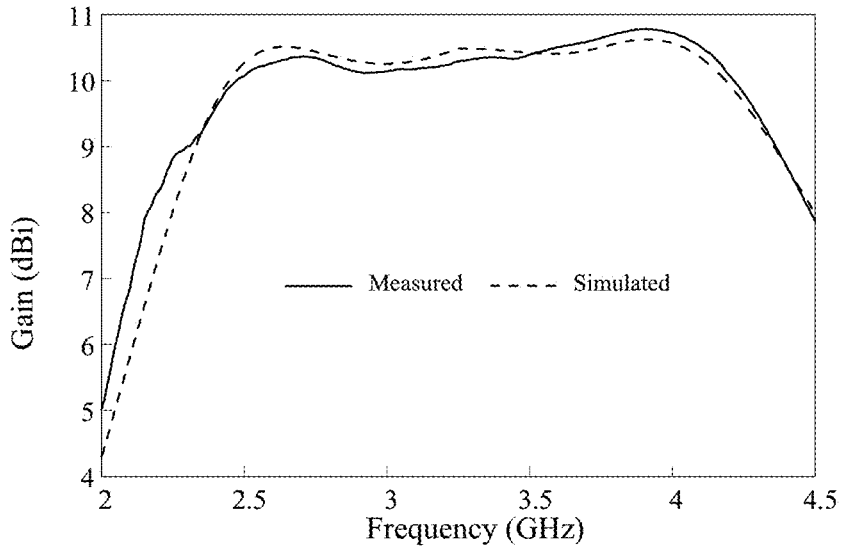
FIGS. 15-16 illustrate measured and simulated gain against frequency for a first port and a second port of a dual-polarized antenna, in accordance with various embodiments.
Figure 16:
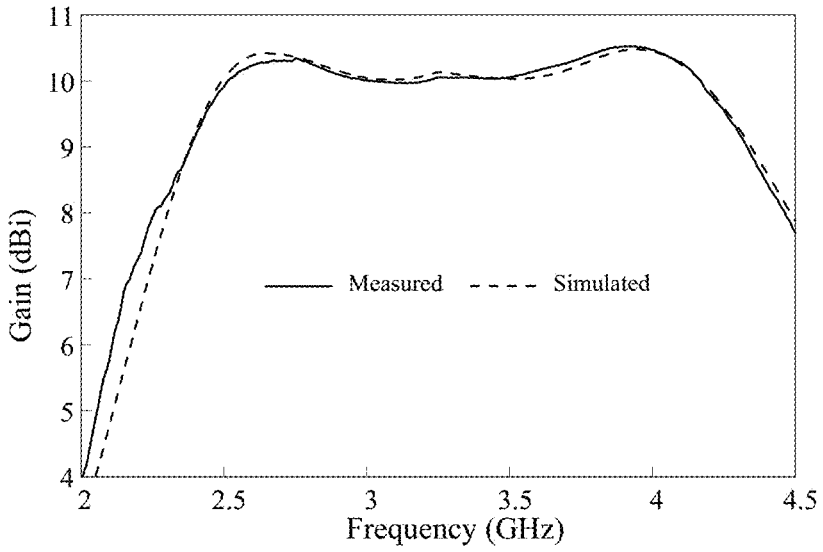
Figure 17:
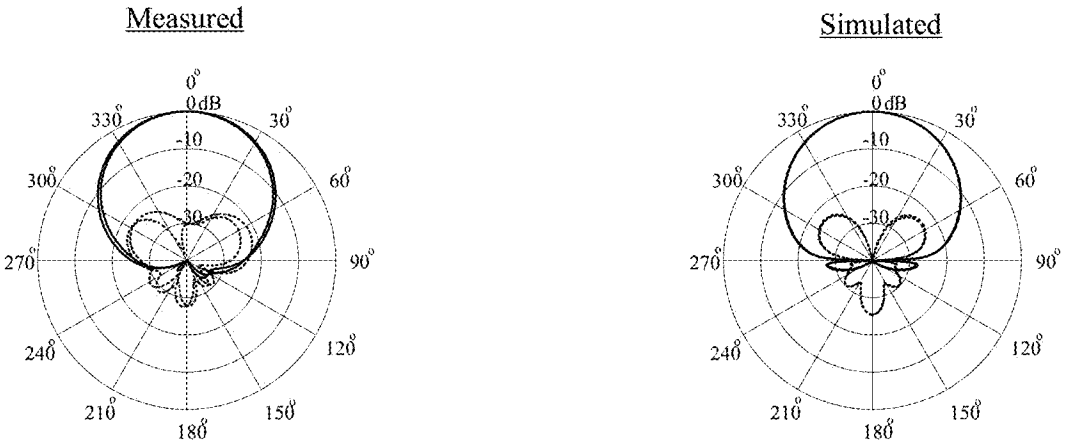
FIGS. 17-21 illustrate measured and simulated radiation patterns for a first port of a dual-polarized antenna, in accordance with various embodiments.
Figure 18:
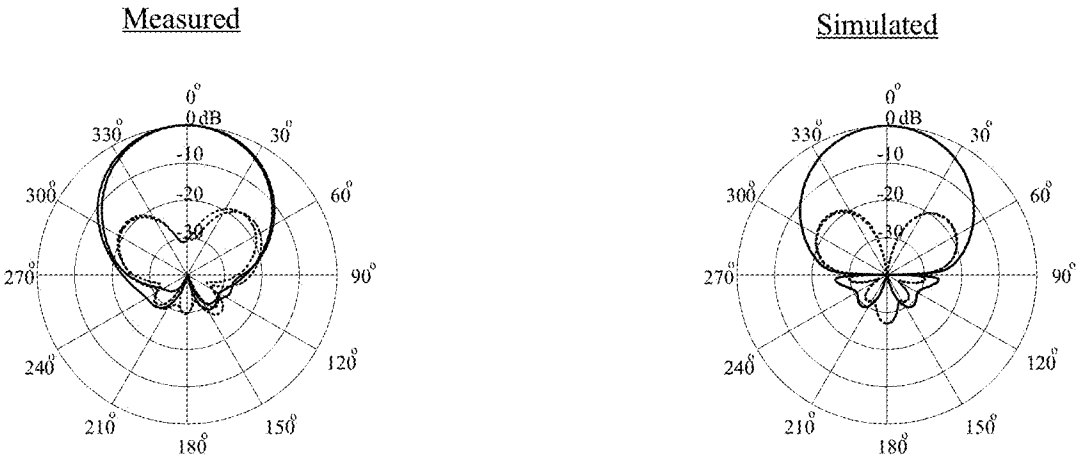
Figure 19:
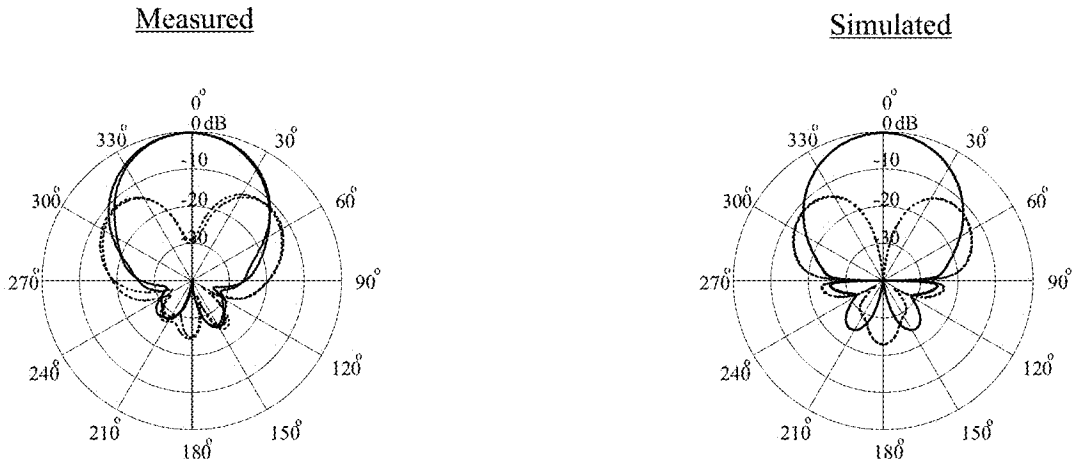
Figure 20:
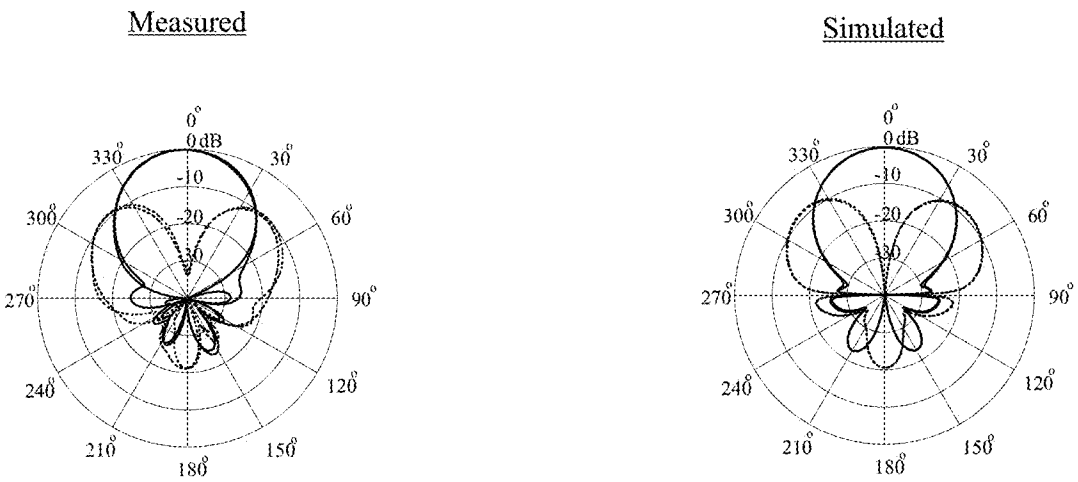
Figure 21:
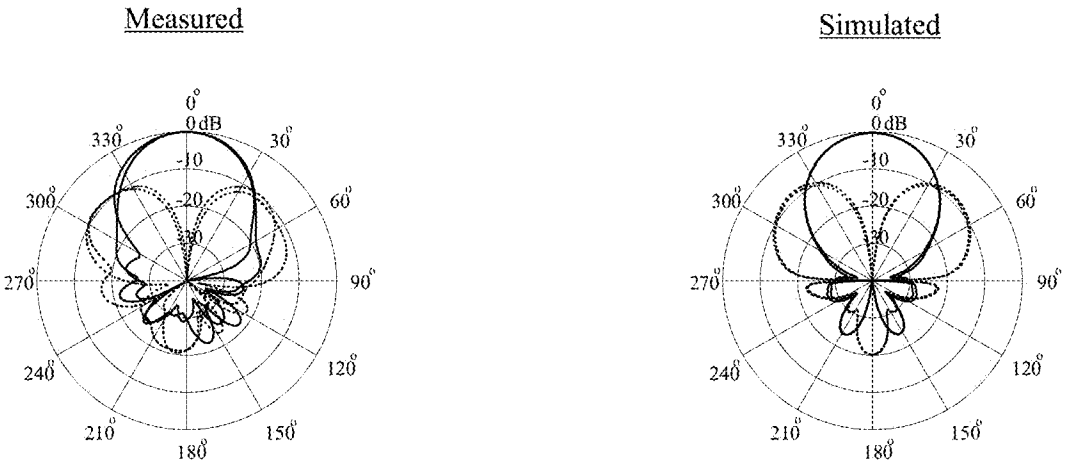
Figure 22:
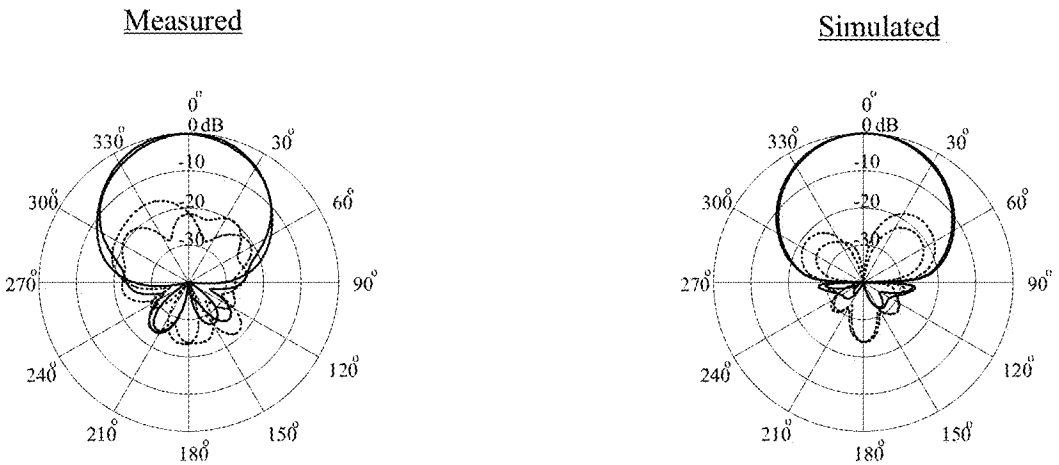
FIGS. 22-26 illustrate measured and simulated radiation patterns for a second port of a dual-polarized antenna, in accordance with various embodiments.
Figure 23:
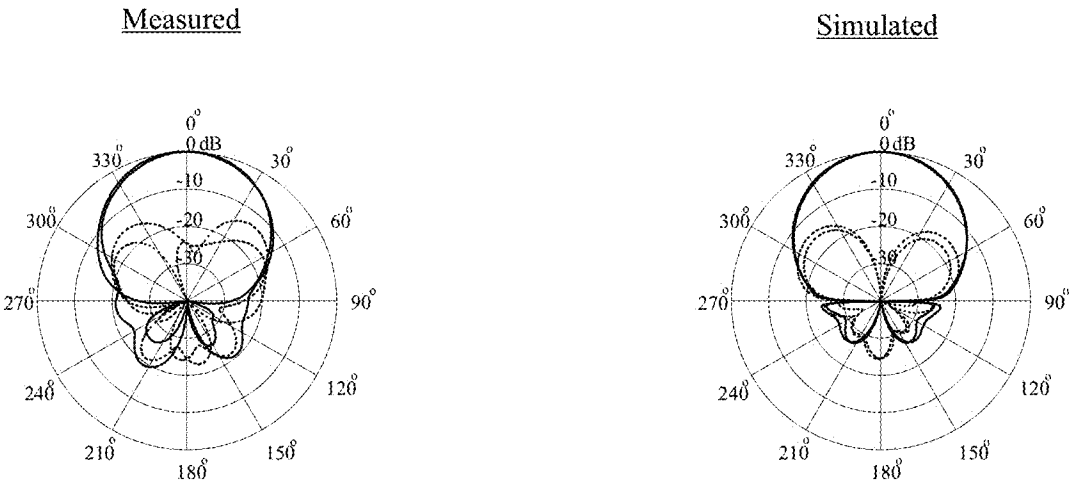
Figure 24:
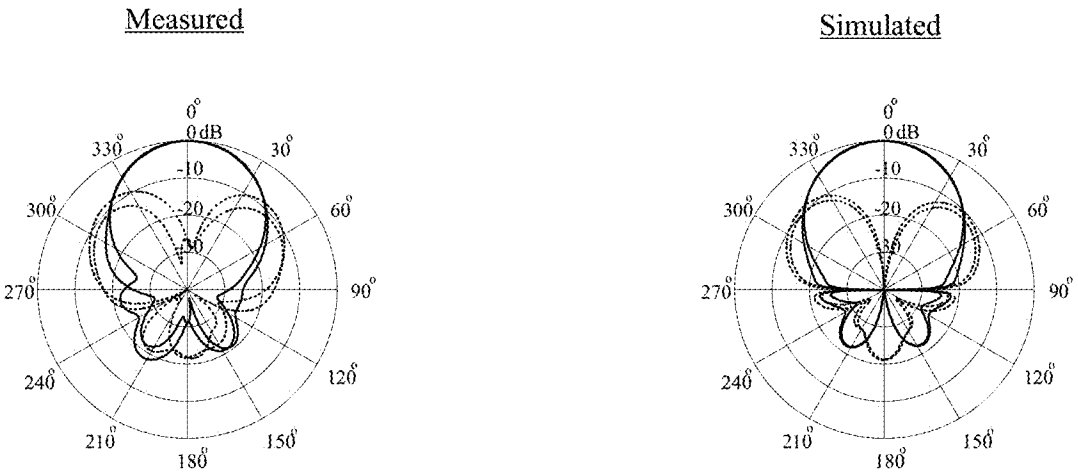
Figure 25:
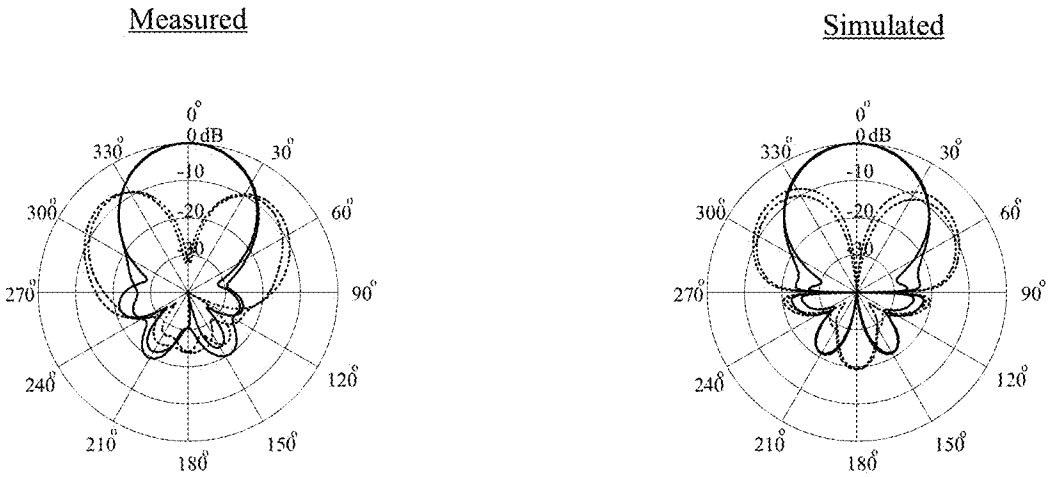
Figure 26:
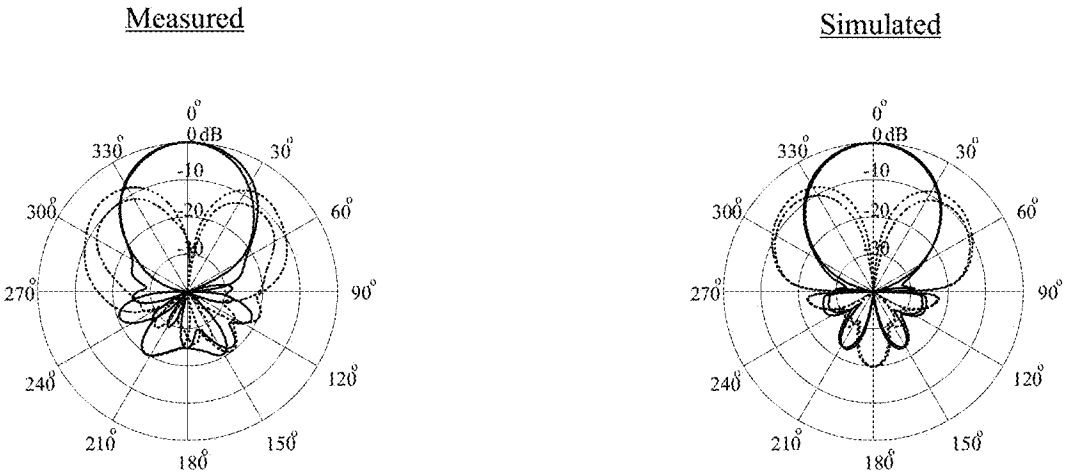

FIGS. 15-16 illustrate measured and simulated gain against frequency for a first port (102) and a second port (104) of a dual-polarized antenna, in accordance with various embodiments. In this regard, the dual-polarized antenna has stable gain and an average measured gain of 10.5 dBi at each port, varying from 9.28 dBi to 10.78 dBi at port 102 and from 9.54 dBi to 10.52 dBi at port 104.

FIGS. 17-21 illustrate measured and simulated radiation patterns for a first port (102) of a dual-polarized antenna, in accordance with various embodiments. In this regard, measured and simulated radiation patterns for the dual-polarized antenna are illustrated at frequencies of 2.6, 2.9, 3.2, 3.5, and 3.8 GHz.

For the half power beamwidth at port 102, described in Table III below, the measured beamwidths are also 57.4° at 2.6 GHz at both planes. When the operating frequency increases from 2.6 GHz to 3.8 GHz, the beamwidths decrease monotonically from 57.4° to 40°.

TABLE III

| | Half power beamwidth | | | |
|---|---|---|---|---|
| | Measured | | Simulated | |
| Plane | 0° | 90° | 0° | 90° |
| 2.6 GHz | 57.4° | 57.4° | 55.5° | 55.4° |
| 2.9 GHz | 53.5° | 53.9° | 54° | 53.5° |
| 3.2 GHz | 46.1° | 47.8° | 48.5° | 48.3° |
| 3.5 GHz | 41.7° | 43.3° | 43.5° | 43.5° |
| 3.8 GHz | 39.9° | 40° | 40° | 40.5° |

FIGS. 22-26 illustrate measured and simulated radiation patterns for a second port (104) of a dual-polarized antenna, in accordance with various embodiments. In this regard, measured and simulated radiation patterns for the dual-polarized antenna are illustrated at frequencies of 2.6, 2.9, 3.2, 3.5, and 3.8 GHz.

As described in Table IV below, the variation of the half power beamwidth at port 104 is same as port 102, and the beamwidths also decrease from 52° to 39° with increasing the operating frequency. In an embodiment, the height of the feeding points (510) of the feeding mechanisms can cause high cross polarization at both ports at high operating frequency. In this regard, the high cross polarization can be reduced by reducing the height of feeding points 510, while the overall height of the dual-polarized antenna is kept the same, e.g., at the expense of an increase in gain variations.

TABLE IV

| | Half power beamwidth | | | |
|---|---|---|---|---|
| | Measured | | Simulated | |
| Plane | 0° | 90° | 0° | 90° |
| 2.6 GHz | 52.9° | 51.5° | 55° | 55° |
| 2.9 GHz | 50.5° | 51.3° | 50.5° | 53° |
| 3.2 GHz | 46.6° | 46.9° | 47° | 47.5° |
| 3.5 GHz | 40.9° | 41.8° | 42.6° | 42.8° |
| 3.8 GHz | 39.2° | 39° | 40.4° | 40.3° |

The above description of illustrated embodiments of the subject disclosure, including what is described in the Abstract, is not intended to be exhaustive or to limit the disclosed embodiments to the precise forms disclosed. While specific embodiments and examples are described herein for illustrative purposes, various modifications are possible that are considered within the scope of such embodiments and examples, as those skilled in the relevant art can recognize.

In this regard, while the disclosed subject matter has been described in connection with various embodiments and corresponding Figures, where applicable, it is to be understood that other similar embodiments can be used or modifications and additions can be made to the described embodiments for performing the same, similar, alternative, or substitute function of the disclosed subject matter without deviating therefrom. Therefore, the disclosed subject matter should not be limited to any single embodiment described herein, but rather should be construed in breadth and scope in accordance with the appended claims below.

What is claimed is:

1. A dual-polarized antenna, comprising:

a ground plane;

a dipole portion electrically coupled to the ground plane, wherein the dipole portion comprises a port comprising a feeding element comprising microstrip lines that are electrically connected, via a shorting pin, to L-shaped strips, and wherein the feeding element is configured to generate an electric dipole and a magnetic dipole;

a shorted patch antenna portion comprising an open end that is electrically coupled to the dipole portion; and a metal plate located at a bottom portion of the dual-polarized antenna.

2. The dual-polarized antenna of claim 1, wherein the ground plane comprises two H-shaped ground planes, and wherein the dipole portion is electrically connected to the two H-shaped ground planes.

3. The dual-polarized antenna of claim 1, wherein the dipole portion comprises four dipoles.

4. The dual-polarized antenna of claim 3, wherein the shorted patch antenna portion comprises four open ends comprising the open end, and wherein the four open ends are electrically coupled to the four dipoles.

5. The dual-polarized antenna of claim 4, further comprising:

two ports, wherein the port is a first port, wherein the two ports comprise the first port and a second port, wherein the feeding source is a first feeding source, wherein the electric dipole is a first electric dipole, wherein the magnetic dipole is a first magnetic dipole, and wherein the second port comprises a second feeding source that generates a second electric dipole and a second magnetic dipole.

6. The dual-polarized antenna of claim 5, wherein a first magnitude of the first electric dipole is equivalent to a second magnitude of the second electric dipole.

7. The dual-polarized antenna of claim 5, wherein a first magnitude of the first magnetic dipole is equivalent to a second magnitude of the second magnetic dipole.

8. The dual-polarized antenna of claim 1, wherein the metal plate is configured to reduce back radiation.

9. The dual-polarized antenna of claim 1, wherein the metal plate comprises a reflector or another ground plane.

10. The dual-polarized antenna of claim 5, wherein the microstrip lines are a first pair of microstrip lines, and wherein the second feeding source comprises a second pair of microstrip lines.

11. The dual-polarized antenna of claim 10, wherein the shorting pin is a first shorting pin, wherein the L-shaped strips are a first pair of L-shaped strips, and wherein the second pair of microstrip lines are electrically connected, via a second shorting pin, to a second pair of L-shaped strips.

12. The dual-polarized antenna of claim 11, wherein the first pair of L-shaped strips is printed on a top layer of a substrate.

13. The dual-polarized antenna of claim 12, wherein the ground plane comprises an H-shaped ground plane that is printed on a bottom layer of the substrate, and wherein the first pair of microstrip lines are printed on a top layer of the substrate.

14. The dual-polarized antenna of claim 1, further comprising:

a balun source corresponding to open portions of the ground plane.

15. An array of antennas, comprising:

a ground plane;

a set of dual-polarized antennas, wherein a dual-polarized antenna of the set of dual-polarized antennas comprises a dipole antenna portion electrically coupled to the ground plane and a shorted patch antenna portion comprising an open end that is electrically coupled to the dipole portion;

a port comprising a feeding source configured to facilitate generation of an electric dipole and a magnetic dipole, wherein the feeding source comprises microstrip lines that are electrically connected, via a shorting pin, to L-shaped strips; and a metal plate located at a bottom portion of the array of antennas.

16. The array of antennas of claim 15, wherein adjacent dual-polarized antennas of the set of dual-polarized antennas are separated by a defined spacing.

17. The array of antennas of claim 15, wherein the metal plate is located below the set of dual-polarized antennas.

18. An antenna, comprising:

an electrically conductive surface;

a half-wave dipole antenna electrically coupled to the electrically conductive surface, wherein the half-wave dipole antenna comprises a feeding element comprising microstrip lines that are electrically connected, using a shorting pin, to L-shaped strips;

a shorted patch antenna comprising an open portion that is electrically coupled to the half-wave dipole antenna; and a metal plate located below the half-wave dipole antenna.

19. The antenna of claim 18, wherein the electrically conductive surface comprises H-shaped ground planes, and wherein the half-wave dipole antenna is electrically connected to the H-shaped ground planes.

20. The antenna of claim 18, wherein the half-wave dipole antenna comprises four half-wave dipoles.

* * * * *